US012054329B2

(12) United States Patent
Komann et al.

(10) Patent No.: US 12,054,329 B2
(45) Date of Patent: Aug. 6, 2024

(54) HOLDING DEVICE COMPRISING FIRST AND SECOND COMPONENTS

(71) Applicant: SCHOTT Pharma Schweiz AG, St. Gallen (CH)

(72) Inventors: Christian Komann, Speicher (CH); Patrick Wolf, St. Gallen (CH); Oscar Carrera, St. Gallen (CH); Arne Kloke, St. Gallen (CH)

(73) Assignee: SCHOTT Pharma Schweiz AG, St. Gallen (CH)

( * ) Notice: Subject to any disclaimer, the term of this patent is extended or adjusted under 35 U.S.C. 154(b) by 149 days.

(21) Appl. No.: 17/489,274

(22) Filed: Sep. 29, 2021

(65) Prior Publication Data

US 2022/0097939 A1 Mar. 31, 2022

(30) Foreign Application Priority Data

Sep. 30, 2020 (EP) ..... 20199384

(51) Int. Cl.
*A61J 1/16* (2023.01)
*B65D 6/08* (2006.01)
(Continued)

(52) U.S. Cl.
CPC ..... *B65D 71/70* (2013.01); *B65D 11/14* (2013.01); *B65D 81/05* (2013.01); *B65D 2571/00246* (2013.01)

(58) Field of Classification Search
CPC ..... B65D 11/14; B65D 71/70; B65D 25/108; B65D 77/2024; B65D 81/05;
(Continued)

(56) References Cited

U.S. PATENT DOCUMENTS 4,124,122 A 11/1978 Emmitt
6,533,133 B2 * 3/2003 Liu ..... B01L 9/06 422/561

(Continued)

OTHER PUBLICATIONS

European Search Report dated Mar. 17, 2021 for European Patent Application Serial No. 20199384.7 (4 pages).

(Continued)

*Primary Examiner* — Steven A. Reynolds
(74) *Attorney, Agent, or Firm* — Taylor IP, P.C.

(57) ABSTRACT

An arrangement includes a holding device for primary packaging containers including: a first component including first receptacles and spanning a first component plane; and a second component including second receptacles and spanning a second component plane. The first component and the second component superimpose one another such that each primary packaging container can be detachably accommodated in one of the first receptacles and the second receptacles such that the first component and the second component together restrict movement of the primary packaging container in one of the component planes and in a direction which is perpendicular to one of the component planes. For each of the first receptacles, there is one of the second receptacles which has a minimum distance from the first receptacle and, for each of the first receptacles, the minimum distance is predetermined by the second component, a third component of the holding device, or both.

17 Claims, 8 Drawing Sheets

(51) Int. Cl.
*B65D 71/70* (2006.01)
*B65D 81/05* (2006.01)

(58) Field of Classification Search
CPC . B65D 2571/00246; A61J 1/16; A61M 5/008; A61M 5/002; A61M 5/001
USPC ..... 206/438, 564, 364
See application file for complete search history.

(56) References Cited

U.S. PATENT DOCUMENTS

| | | | | |
|---|---|---|---|---|
| 9,776,188 | B1 * | 10/2017 | Kamees | B01L 9/50 |
| 10,669,195 | B2 * | 6/2020 | Abbott, Jr. | B08B 9/42 |
| 10,932,647 | B1 * | 3/2021 | Audibert | A47L 15/505 |
| 11,173,096 | B2 * | 11/2021 | Nicolas | A61M 5/008 |
| 2002/0108917 | A1 * | 8/2002 | Maruyama | B01L 9/50 211/74 |
| 2006/0266719 | A1 * | 11/2006 | Knight | G01N 35/025 211/74 |
| 2014/0008249 | A1 * | 1/2014 | Muller | B65D 5/5059 206/139 |
| 2019/0256266 | A1 * | 8/2019 | Komann | B65D 25/108 |
| 2019/0343721 | A1 * | 11/2019 | Komann | B65D 71/70 |
| 2020/0246223 | A1 * | 8/2020 | Nicolas | B65D 25/108 |
| 2022/0096732 | A1 * | 3/2022 | Komann | B01L 9/06 |

OTHER PUBLICATIONS

European Office Action dated Mar. 29, 2021 for European Patent Application Serial No. 20199384.7 (5 pages).

* cited by examiner

HOLDING DEVICE COMPRISING FIRST AND SECOND COMPONENTS

CROSS REFERENCE TO RELATED APPLICATIONS

This application claims priority to European Patent Application No. EP 20199384.7 filed on Sep. 30, 2020, which is incorporated in its entirety herein by reference.

BACKGROUND OF THE INVENTION

1. Field of the Invention

The invention refers to a holding device for holding a plurality of packaging containers. Further, the invention pertains to an arrangement which includes the holding device and at least part of the primary packaging containers, and to a process for preparing a first holding device.

2. Description of the Related Art

Containers made from glass and later on also from polymer have been applied for transporting fluids and powders safely for a long time. In the last decades, the arts in which glass and polymer containers are used for transporting fluids and powders have become increasingly diverse and sophisticated. One such art is the technical field of the present application: pharmaceutical packaging. In the pharmaceutical industry, containers—such as vials, syringes, ampoules and cartridges—are used as primary packaging for all kinds of pharmaceutically relevant compositions, in particular drugs, such as vaccines, and also for cosmetical compositions, in particular cosmetical compositions which are to be injected into the skin.

In the processing of containers for use in pharmaceutical or cosmetical applications, generally so-called nested solutions are preferred nowadays, where a holding structure for containers (also referred to as nest) is used for concurrently holding or supporting a plurality of primary packaging containers in a given configuration. An example of a known nested solution is commercially available from Schott AG under the tradename SCHOTT iQ® platform. The nest with the primary packaging containers is usually delivered to a customer, such as a pharmaceutical company or filler, packaged in a transport or packaging container (also referred to as tub). For further processing the primary packaging containers, the tub is opened. Further processing the primary packaging containers often includes automated steps of removing the primary packaging containers from the tub; filling the primary packaging containers with a composition, e.g. a pharmaceutical or cosmetical composition; closing the pre-filled primary packaging containers; and vacuum packaging individual primary packaging containers in thin foil bags for retail. Each of the preceding steps bears a risk of processing failures. Such failures may, in particular, occur if the nested solution does not precisely meet the geometrical specifications which the automated processing relies on. For example, in many cases the height difference between the upper rim of the tub, which frames the tub opening and to which often a lid is sealed, and the uppermost part of the primary packaging containers when held in the nest must be within a tolerance as narrow as 1 mm.

Often, however, the primary packaging containers are not adapted to an existing nested solution, but a nested solution has to be designed for given primary packaging containers. This means that each time a nested solution is needed for a new kind of primary packaging container, a length of which differs by 1 mm or more from a previous primary packaging container, a new nested solution, in particular a new holding structure, has to be designed. As these holding structures are often manufactured by injection molding, new molding tools have to be provided as well. Plainly, this is a lot of labor and effort for packaging primary packaging containers which merely differ from primary packaging containers with existing nested solution by a length of one or several mm more or less.

Further, not only the length but also the diameter of the primary packaging containers may change from product to product. If an existing holding structure design is to be adapted to a new primary packaging container diameter, different inserts have to be used in the injection molding tools. Exchanging these inserts is often cumbersome if not even impossible. This is particularly true in the case of rather long primary packaging containers which require holding structures of greater thickness or height for safe and secure holding.

What is needed in the art is a way to at least partly overcome a disadvantage arising from the prior art.

SUMMARY OF THE INVENTION

In some exemplary embodiments provided according to the invention, an arrangement includes: a holding device for holding a plurality of at maximum n primary packaging containers, n being a positive integer. The holding device includes: a first component including a plurality of n first receptacles, a length and a width of the first component spanning a first component plane; and a second component including a plurality of n second receptacles, a length and a width of the second component spanning a second component plane. The first component and the second component superimpose one another such that each of the n primary packaging containers can be detachably accommodated in one of the n first receptacles and, at the same time, one of the n second receptacles such that the first component and the second component together restrict movement of the respective primary packaging container in the first component plane or the second component plane and in a direction which is perpendicular to the first component plane or the second component plane. For each of the n first receptacles, there is one of the n second receptacles which has a minimum distance from the respective first receptacle and, for each of the n first receptacles, the minimum distance is predetermined by the second component, at least one third component of the holding device, or both.

In some exemplary embodiments provided according to the invention, a process includes: a. providing at least one first component including a plurality of n first receptacles, and a second component including a plurality of n second receptacles, a length and a width of each least one first component spanning a first component plane and a length and a width of the second component spanning a second component plane; and b. superimposing one of the at least one first component and the second component with one another to obtain a first holding device for holding a plurality of at maximum n primary packaging containers of a first kind, n being a positive integer. In the first holding device, each of the n primary packaging containers of the first kind can be detachably accommodated in one of the n first receptacles and, at the same time, one of the n second receptacles such that the superimposed first component and the second component together restrict movement of the respective primary packaging container of the first kind in the first component plane or the second component plane and in a direction which is perpendicular to the first component plane or to the second component plane. For each of the n first receptacles, there is one of the n second receptacles which has a minimum distance from the respective first receptacle and, for each of the n first receptacles, the minimum distance is predetermined by the second component, at least one third component of the first holding device, or both.

Exemplary embodiments provided according to the invention provide a holding device for holding a plurality of primary packaging containers for medical, pharmaceutical or cosmetical compositions in a nested solution, where the design of the holding device and production tools for manufacturing the holding device can more easily be adapted to primary packaging containers of different length or different diameter or both such that tight specifications which allow for an automated processing of the primary packaging containers are met.

Exemplary embodiments provided according to the invention provide a holding device for holding a plurality of primary packaging containers for medical, pharmaceutical or cosmetical compositions in a nested solution, where the holding device allows for a beneficial combination of easy demolding of the holding device from molding tools, secure holding of the primary packaging containers, and high suitability of the nested solution for an automated processing, in particular using a robotic gripper arm.

Exemplary embodiments provided according to the invention provide one of the above beneficial holding devices, which further allows holding all of its primary packaging containers equally secure and safe.

Exemplary embodiments provided according to the invention provide a less complex and less costly process for producing holding devices of nested solution for holding primary packaging containers of different lengths or diameters or both, where the nested solution still meets specifications for an automated processing.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
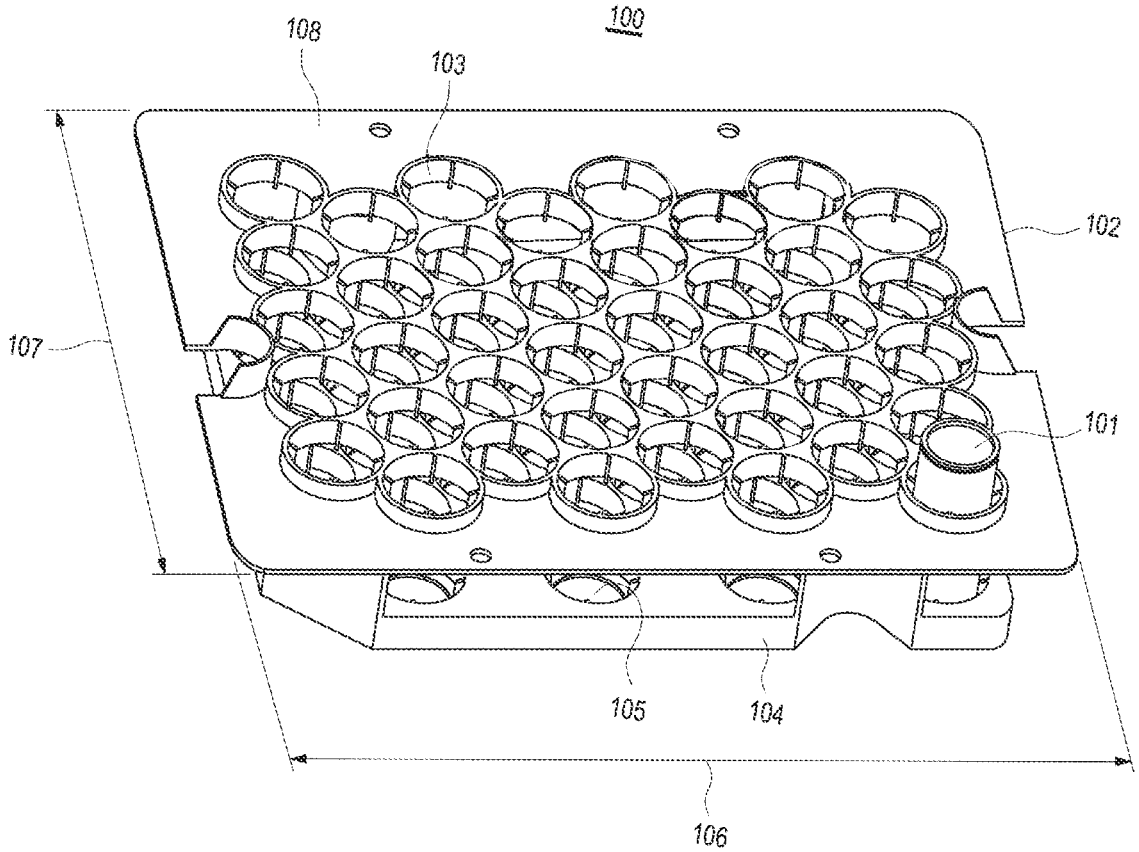
FIG. 1 illustrates a scheme of an exemplary embodiment of a holding device provided according to the invention from above.

In some exemplary embodiments provided according to the invention, a holding device for holding a plurality of at maximum n primary packaging containers is provided and n is a positive integer. The holding device includes a first component including a plurality of n first receptacles and a second component including a plurality of n second receptacles. A length and a width of the first component span a first component plane and a length and a width of the second component span a second component plane. The first component and the second component superimpose one another such that each of the n primary packaging containers can be, for example non-destructively, detachably accommodated in one of the n first receptacles and, at the same time, one of the n second receptacles such that the first component and the second component together restrict movement of the respective primary packaging container in the first component plane or the second component plane, and in a direction which is perpendicular to the first component plane or the second component plane. For each of the n first receptacles, there is one of the n second receptacles which has a minimum distance from the respective first receptacle. For each of the n first receptacles, the minimum distance is predetermined by the second component, or at least one third component of the holding device, or both.

In order to predetermine the minimum distance, the second component may include one or more spacer elements, such as one or more pillars. In the case of one or more third components predetermining the minimum distance, the one or more third components are, for example, designed and arranged as one or more spacer elements.

The recitation of the first component and the second component together restricting a movement of the respective primary packaging container means that one of the first component and the second component alone is not sufficient to restrict the movement in the described way. Instead, the first component and the second component are needed to cooperate to restrict the movement in the described way.

Herein, a movement of a primary packaging container in a plane is restricted by a component if the primary packaging container may be moved to a predetermined degree in the plane, but a contact to the component prevents any reasonable, for example non-destructive, further movement in any direction within the plane. Accordingly, a movement of a primary packaging container in a direction is restricted by a component if the primary packaging container may be moved to a predetermined degree in the direction, but a contact to the component prevents any reasonable, for example non-destructive, further movement in the direction.

Herein, entities, such as components, which superimpose one another may follow one another directly or indirectly. In some embodiments, the entities follow one another directly.

A primary packaging container is non-destructively detachably accommodated in a receptacle if the primary packaging container can be withdrawn from the receptacle without damaging the primary packaging container and, for example, also without damaging the receptacle.

In some embodiments, for each of the n first receptacles the minimum distance is essentially the same.

In some embodiments, the first component and the second component superimpose one another such that each of the n primary packaging containers can be accommodated in one of the n first receptacles and, at the same time, one of the n second receptacles such that a] the first component restricts movement of the respective primary packaging container at least in the first component plane and the second component restricts movement of this primary packaging container in the direction which is perpendicular to the first component plane, or b] the second component restricts movement of the respective primary packaging container at least in the second component plane and the first component restricts movement of this primary packaging container in the direction which is perpendicular to second component plane.

In some embodiments, the first component and the second component are non-destructively detachably, or not non-destructively detachably attached to one another, or to the at least one third component, or both.

In some embodiments, the first component and the second component are attached to one another by one selected from the group consisting of an adhesive bond, a form-fit, a force-fit, and the at least one third component, or by a combination of at least two thereof.

In some embodiments, the first component and the second component have been attached to one another, or to the at least one third component, or both, in each case by one selected from the group consisting of welding, staking, and gluing or by a combination of at least two thereof.

In some embodiments, the welding is one selected from the group consisting of an ultrasound welding, a laser welding, and a friction welding, or a combination of at least two thereof.

In some embodiments, in the direction which is perpendicular to the first component plane or the second component plane, each of the n first receptacles is aligned with one of the n second receptacles. In some embodiments, the first receptacle and the second receptacle which are aligned with one another in the preceding manner have the minimum distance from one another.

In some embodiments, the first component or the second component or each of both is plate-like. A component is plate-like if its length and width are at least 3 times, such at least 5 times or at least 10 times, a thickness of the component. In some embodiments, the plate-like component is essentially rectangular in a top view.

In some embodiments, the n first receptacles form a first regular pattern in the first component plane, the n second receptacles form a second regular pattern in the second component plane, and the first regular pattern is congruent with the second regular pattern.

In some embodiments, the holding device includes at least part of the n primary packaging containers, for example all of the n primary packaging containers. In some embodiments, each of the at least part of the n primary packaging containers is, for example non-destructively, detachably accommodated in one of the n first receptacles and, at the same time, one of the n second receptacles such that the first component and the second component together restrict movement of the respective primary packaging container in the first component plane or the second component plane, and in a direction which is perpendicular to the first component plane or the second component plane.

In some embodiments, the n primary packaging containers are primary packaging containers for pharmaceutical, medical or cosmetic compositions.

In some embodiments, each of the n primary packaging containers includes, in the following sequence along its length a} a first end part, comprising a discharge orifice, b} a body part, and c} a further end part.

In some embodiments, the body part is of cylindrical shape.

In some embodiments, the further end part is a standing base, or includes a further orifice, or both. An exemplary further orifice is designed to accommodate a plunger.

In some embodiments, for each of the n primary packaging containers, an area of the further orifice is more than an area of the discharge orifice.

In some embodiments, the further end part further includes a rim which projects laterally from the body part and at least partially, for example fully, hems the further orifice.

In some embodiments, the holding device further includes a secondary packaging container, a container body of the secondary packaging container including A. a container opening, and B. a container base which is opposite to the container opening, at least the first component and the second component, and in some embodiments also the third component, are arranged completely in the secondary packaging container.

In some embodiments, the secondary packaging container is a tub or tub-shaped.

In some embodiments, the second component superimposes the first component on a side of the first component which faces away from the container opening, or on a side of the first component which faces away from the container base.

In some embodiments, the first component and the second component, and in some embodiments also the third component, are designed and arranged such that each of the n primary packaging containers can be, for example non-destructively, detachably accommodated in one of the n first receptacles and, at the same time, one of the n second receptacles with the further end part of each of the n primary packaging containers facing the container opening or the container base.

In some embodiments, the first end part of each of the n primary packaging containers includes a connecting element, the connecting element including a thread for connecting an auxiliary part to the respective primary packaging container. An exemplary auxiliary part is one selected from the group consisting of a needle, a nozzle, and a tubing, or a combination of at least two therefore. An exemplary needle is a hypodermic needle.

In some embodiments, the first end part of each of the primary packaging containers includes a male part of a taper fitting. An exemplary taper fitting is a Luer taper. Generally, the Luer taper may include a thread or not.

In some embodiments, the male part of the taper fitting includes a thread. In some embodiments, the thread is arranged in a sleeve.

In some embodiments, for each of the n primary packaging containers, throughout the body part a thickness of a container wall is in a range from ±0.3 mm, such as ±0.2 mm, ±0.15 mm, ±0.1 mm, or ±0.08 mm, in each case based on a mean value of the thickness of the container wall in the body part of the respective primary packaging container.

In some embodiments, for each of the n primary packaging containers, throughout the body part a thickness of a container wall is in a range from 0.2 to 3 mm, such as from 0.3 to 2.5 mm or from 0.4 to 2.2 mm. In some embodiments, for each of the primary packaging containers, throughout the body part a thickness of a container wall is in a range from 1.0 to 1.1 mm. In some embodiments, for each of the n primary packaging containers, throughout the body part a thickness of a container wall is in a range from 1.4 to 1.8 mm. In some embodiments, for each of the n primary packaging containers, throughout the body part a thickness of a container wall is in a range from 0.6 to 2.0 mm.

In some embodiments, each of the n primary packaging containers has a container interior with a volume in a range from 0.5 to 100 mL, such as from 1 to 100 mL, from 1 to 50 mL, from 1 to 10 mL, or from 2 to 10 mL.

In some embodiments, the n primary packaging containers are selected from the group consisting of vials, syringes, cartridges, and ampoules, or a combination of at least two thereof. An exemplary cartridge is designed for being used as a reservoir in a, for example portable, medical device. An exemplary portable medical device is an insulin pump.

In some embodiments, each of the n primary packaging containers includes a container wall which at least partially surrounds a container interior, the container wall including, for example consisting of, a glass, or a polymer, or both.

In some embodiments, the polymer is a cyclic olefin copolymer, or a cycloolefin polymer, or a mixture thereof.

In some embodiments, the glass is of a type selected from the group consisting of a borosilicate glass, for example a type I glass; an aluminosilicate glass; and fused silica; or of a combination of at least two thereof.

In some embodiments, n is in a range from 4 to 500, such as from 9 to 400, from 12 to 300, from 16 to 200, from 16 to 160, from 16 to 100, from 16 to 90, from 16 to 80, from 16 to 70, from 16 to 60, or from 16 to 50.

In some embodiments, each of the n first receptacles has a first opening which faces the second component, each of the n second receptacles has a second opening which faces the first component, the first openings of the n first receptacles each have a first holding diameter, the second openings of the n second receptacles each have a second holding diameter, wherein, for each of the first receptacles of the plurality of n first receptacles, a modulus of a difference between its first holding diameter and the second holding diameter of the one of the n second receptacles which has the minimum distance from this first receptacle is not more than 0.5 mm, such as in a range from 0.0 to 0.5 mm, in a range from 0.1 to 0.4 mm, or in a range from 0.2 to 0.3 mm. In some embodiments, the primary packaging containers, for example, have a length of at least 50 mm, such as at least 60 mm, at least 70 mm, or at least 80 mm. Often the primary packaging containers are not longer than 300 mm.

In some exemplary embodiments provided according to the invention, an arrangement includes the previously described holding device and at least part of the n primary packaging containers, for example all of the n primary packaging containers; each of the at least part of the n primary packaging containers is, for example non-destructively, detachably accommodated in one of the n first receptacles and one of the n second receptacles such that the first component and the second component together restrict movement of the respective primary packaging container in a) the first component plane or the second component plane, and b) in a direction which is perpendicular to the first component plane or the second component plane.

In some embodiments, each of the at least part of the n primary packaging containers is, for example non-destructively, detachably accommodated in one of the n first receptacles and one of the n second receptacles such that a] the first component restricts movement of the respective primary packaging container at least in the first component plane and the second component restricts movement of this primary packaging container in the direction which is perpendicular to the first component plane, or b] the second component restricts movement of the respective primary packaging container at least in the second component plane and the first component restricts movement of this primary packaging container in the direction which is perpendicular to second component plane.

In some embodiments, the arrangement further includes a secondary packaging container, a container body of the secondary packaging container includes A. a container opening, and B. a container base which is opposite to the container opening, at least the first component and the second component, and in some embodiments also the third component, are arranged completely in the secondary packaging container.

In some embodiments, the secondary packaging container is closed by a lid which is joined to the container body. An exemplary lid is a multi-layer sheet. Additionally or alternatively, the lid may be gas-permeable.

In some embodiments, the arrangement further includes a, for example closed, outer packaging, the secondary packaging container being arranged in the outer packaging. An exemplary outer packaging is a pouch, for example made from a plastic film. Additionally or alternatively, the outer packaging may provide a barrier against a permeation of an inert gas. Additionally or alternatively, the outer packaging may be hermetically sealed. Additionally or alternatively, the outer packaging may be less permeable for the inert gas than the lid. In some embodiments, the outer packing provides a barrier action against a permeation of the inert gas, whereas the lid is permeable for the inert gas.

In some embodiments, the outer packaging includes an atmosphere which comprises an inert gas at a proportion of at least 50 vol.-%, such as at least 60 vol.-%, at least 70 vol.-%, at least 80 vol.-%, at least 90 vol.-%, or at least 95 vol.-%, in each case based on a volume of the atmosphere.

In some embodiments, the primary packaging containers have been decontaminated, for example sterilized. In some embodiments, the arrangement has been decontaminated, for example sterilized. In the context of the present application, decontamination is defined as an umbrella term for reducing the amount of microbes and biological agents, such as fungi, bacteria, viruses, spore forms, prions, unicellular eukaryotic organisms, etc. The special terms disinfection and sterilization differ in the amount of reduction of these. While disinfection only reduces the amount of said contaminants, sterilization effectively kills, deactivates, or eliminates all forms of life and other biological agents which are present, i.e. a reduction of 100%. Hence, disinfection is less effective than sterilization.

In some exemplary embodiments provided according to the invention, a process includes as process steps a. providing, for example forming, i. at least one first component including a plurality of n first receptacles, and ii. a second component including a plurality of n second receptacles, a length and a width of each first component span a first component plane and a length and a width of the second component span a second component plane; and b. superimposing one first component and the second component with one another, thereby obtaining a first holding device for holding a plurality of at maximum n primary packaging containers of a first kind, n being a positive integer;

in the first holding device, each of the n primary packaging containers of the first kind can be, for example non-destructively, detachably accommodated in one of the n first receptacles and, at the same time, one of the n second receptacles such that the first component and the second component together restrict movement of the respective primary packaging container of the first kind in a) the first component plane or the second component plane, and b) in a direction which is perpendicular to the first component plane or to the second component plane;

for each of the n first receptacles, there is one of the n second receptacles which has a minimum distance from the respective first receptacle; for each of the n first receptacles, the minimum distance is predetermined by the second component, or at least one third component of the first holding device, or both.

In some embodiments, the first holding device is the previously described holding device provided according to the invention.

In some embodiments, the n primary packaging containers of the first kind are the n primary packaging containers as previously specified in the holding device or the arrangement provided according to the invention.

In some embodiments, in the process step a. the at least one first component, or the second component, or each of both is manufactured by a molding method, for example by an injection molding method.

In some embodiments, the process additionally includes a step of providing, for example forming, at least one third component.

In some embodiments, the at least one third component is manufactured by a molding method, for example by an injection molding method.

In some embodiments, in the process step b. the first component and the second component are non-destructively detachably, or not non-destructively detachably attached to one another, or to the at least one third component, or both.

In some embodiments, in the process step b. the first component and the second component are attached to one another by one selected from the group consisting of an adhesive bond, a form-fit, a force-fit, and the at least one third component, or by a combination of at least two thereof.

In some embodiments, in the process step b. the first component and the second component are attached to one another, or to the at least one third component, or both, in each case by one selected from the group consisting of welding, staking, and gluing or by a combination of at least two thereof.

In some embodiments, the welding is one selected from the group consisting of an ultrasound welding, a laser welding, and a friction welding, or a combination of at least two thereof.

In some embodiments, in the process step a. at least two first components are provided and the process additionally includes A. providing, for example forming, a fourth component including a plurality of m third receptacles; and B. superimposing one first component and the fourth component with one another, thereby obtaining a further holding device for holding a plurality of at maximum m primary packaging containers of a further kind, m being a positive integer which is equal or less than n; a length and a width of the fourth component span a fourth component plane; in the further holding device, each of the m primary packaging containers of the further kind can be, for example non-destructively, detachably accommodated in one of the n first receptacles and, at the same time, one of the m third receptacles such that the first component of the further holding device and the fourth component together restrict movement of the respective primary packaging container of the further kind in A) the first component plane of the first component of the further holding device or the fourth component plane, and B) in a direction which is perpendicular to the first component plane of the first component of the further holding device or to the fourth component plane; for each of the m third receptacles, there is one of the n first receptacles of the first component of the further holding device which has a minimum distance from the respective third receptacle; for each of the m third receptacles, the minimum distance is predetermined by the fourth component, or at least one fifth component of the further holding device, or both. The first components of the first and further holding devices are, for example, substantially identical.

In some embodiments, the fourth component is different from the second component. This may be desired if, for each of the m third receptacles, the minimum distance is predetermined by the fourth component or by the fourth component and the at least one fifth component, or if, for each of the n first receptacles of the first holding device, the minimum distance is predetermined by the second component or by the second component and the at least one third component, or both. Additionally or alternatively, the at least one third component may be different from the at least one fifth component. This may be desirable if, for each of the m third receptacles, the minimum distance is predetermined by the at least one fifth component or by the fourth component and the at least one fifth component, or if, for each of the n first receptacles of the first holding device, the minimum distance is predetermined by the at least one third component or by the second component and the at least one third component, or both.

In some embodiments, the fourth component and the second component are substantially identical. This may be desired if, for each of the m third receptacles, the minimum distance is predetermined by the at least one fifth component, or if, for each of the n first receptacles of the first holding device, the minimum distance is predetermined by the at least one third component, or both.

In some embodiments, each of the n primary packaging containers of the first kind has a first length, each of the m primary packaging containers of the further kind has a further length, and the first length is different from the further length, for example by a difference in a range from 1 to 200 mm, from 1.5 to 150 mm, from 2 mm to 100 mm, from 3 to 90 mm, or from 5 to 85 mm. In some embodiments, the primary packaging containers of the first and further kinds are of the same general type. Here, the general type is, for example, one of vial, ampoule, syringe and cartridge.

Features described as exemplary in some embodiments provided according to the invention, for example according to the holding device, are analogously exemplary in other embodiments provided according to the invention, such as the arrangement and the process.

Holding Device

The holding device provided according to the invention may, generally, be any device which, for the skilled person, comes into consideration for holding the plurality of primary packaging containers. An exemplary holding device is a carrier structure of a so-called nested solution as they are generally known in the technical field of transport packaging for medical, pharmaceutical and cosmetical primary packaging containers. An example of a known nested solution is commercially available from Schott AG under the tradename SCHOTT iQ® platform. An exemplary holding device has been prepared by deep drawing or injection molding. Additionally or alternatively, the holding device may be made from one or more plastics.

Components of Holding Device

The first through fifth components of holding devices provided according to the invention may be of any shape or material which the skilled person deems appropriate in the context of the invention. None of the first through fifth components has been prepared in one piece with any component of the rest of the first through fifth components. In other words: none of the first through fifth components is of a one-piece design which encompasses any component of the rest of the first through fifth components. Each of the first through fifth components itself has, however, been prepared in one piece and is of a one-piece design. In some embodiments, one or more, for example all, of those components are made from one or more plastics. Additionally or alternatively, one or more, for example all, of those components may have a shore A hardness of at least 80, such as at least 90. Additionally or alternatively, one or more, for example all, of the first, second and fourth components is of a plate-like shape. In some embodiments, a width and a length of one or more, for example all, of the first, second and fourth components are each at least 3 times, such as at least 5 times, at least 10 times, or at least 20 times, a thickness of the respective component. An exemplary first through fifth component has been prepared by deep drawing or injection molding.

The first through third receptacles may be any kind of receptacle which the skilled person deems appropriate to accommodate the primary packaging containers such that a first and a second receptacle, or a first and a third receptacle together are suitable for holding a primary packaging container. An exemplary receptacle is in form of a through-hole or cup-like. In case of a cup-like receptacle, a bottom of the receptacle may be open. In that case, the bottom of the receptacle, for example, includes, for example consists of, a rim which is designed for holding a primary packaging container against gravity. A receptacle which is in form of a through-hole is suitable for restricting movement of a primary packaging container in a component plane of the component which includes the receptacle. A cup-like receptacle is suitable for restricting movement of a primary packaging container in a direction which is perpendicular to a component plane of the component which includes the receptacle. In some embodiments, the cup-like receptacle is, in addition, suitable for restricting movement of the primary packaging container in the component plane. Accordingly, if a component is to restrict movement of primary packaging containers in a component plane, the receptacles of the component are, for example, through-holes. If a component is to restrict movement of primary packaging containers in a direction which is perpendicular to a component plane, the receptacles of the component are, for example, cup-like. Herein, a receptacle which is a through-hole has side walls but no bottom which is designed for holding a primary packaging container. A cup-like receptacle includes side wall and a bottom which is designed for holding a primary packaging container against gravity. In any case, the side walls are designed for restricting movement of a primary packaging container in a component plane. The side walls of an exemplary receptacle include a plurality of protrusions which protrude radially inwards towards a lateral center of the receptacle. The protrusions are, for example, designed to restrict movement of a primary packaging container in a component plane by radially inwards facing contact surfaces. At least part of each of the contact surfaces of the plurality of protrusions of the side walls of a receptacle lie on a cylinder shell surface. Additionally or alternatively, the receptacles of a component may be arranged in a regular pattern, for example in an array which consists of rows and columns which are, for example, perpendicular to one another.

Primary Packaging Container

The primary packaging containers may have any size or shape which the skilled person deems appropriate in the context of the invention. An exemplary primary packaging container is a primary packaging container for a medical, pharmaceutical or cosmetical composition. In some embodiments, the primary packaging container is suitable for packaging parenteralia in accordance with section 3.2.1 of the European Pharmacopoeia, 7th edition from 2011. In some embodiments, the primary packaging container is a vial, syringe, cartridge or ampoule.

In some embodiments, each of the n primary packaging containers includes, in the following sequence along its length a first end part including a discharge orifice; a body part; and a further end part. In some embodiments, a first end part of the container includes a discharge orifice, which allows for discharging a medical, pharmaceutical or cosmetical composition from the container interior of the primary packaging container. In that case, the container wall of the primary packaging container encloses the container interior only partially. An exemplary primary packaging container, the first end part of which includes a discharge orifice is a vial, a syringe or a cartridge. An exemplary primary packaging container, the first end part of which does not include a discharge orifice is an ampoule. In that case, the container wall of the primary packaging container entirely encloses the container interior. Additionally or alternatively, the further end part is a standing base, or includes a further orifice, or both. In the case of a further orifice, the primary packaging container, for example, is a syringe. In the case of a standing base, the primary packaging container, for example, is a vial, cartridge or ampoule. For an exemplary primary packaging container, the body part follows the first end part a shoulder. This exemplary primary packaging container may be a vial, syringe, cartridge or ampoule. Additionally or alternatively, the further end part may follow the body part via a heel. In that case, the primary packaging container, for example, is a vial, cartridge or ampoule. In some embodiments, the body part is a lateral region of the primary packaging container. In some embodiments, the body part of the container wall forms a hollow cylinder. In case of a syringe, the body part of cylindrical shape is often referred to as barrel. Additionally or alternatively, the first end part includes, for example consists of, from top to bottom of the primary packaging container a flange and a neck. In this case, the primary packaging container, for example, is a vial, cartridge or ampoule.

The primary packaging container may be a glass container, a wall of glass (container wall) of which at least partially encloses an container interior of the primary packaging container. In some embodiments, the wall of glass is of a one-piece design. The wall of glass may be made by blow molding a glass melt; or by preparing a tube of a glass, for example in form of a hollow cylinder, forming the bottom of the container from one end of the tube, thereby closing the tube at this end, and forming the top region of the primary packaging container from the opposite end of the tube. In some embodiments, the wall of glass is transparent. Alternatively, the container wall may be made from a polymer. In that case, the container wall may also be transparent.

For the use in this document, the interior volume of the container interior represents the full volume of the interior of the primary packaging container. This volume may be determined by filling the interior of the primary packaging container with water up to the brim and measuring the volume of the amount of water which the interior can take up to the brim. Hence, the interior volume as used herein is not a nominal volume as it is often referred to in the technical field of pharmacy. This nominal volume may for example be less than the interior volume by a factor of about 0.5.

Glass

The container wall of each of the primary packaging containers, for example, includes a glass, for example essentially consists of the glass. This glass may be any type of glass and may have any composition which the skilled person deems suitable in the context of the invention. In some embodiments, the glass is suitable for pharmaceutical packaging. In some embodiments, the glass is of type I in accordance with the definitions of glass types in section 3.2.1 of the European Pharmacopoeia, 7th edition from 2011. Additionally or alternatively to the preceding, the glass may be selected from the group consisting of a borosilicate glass, an aluminosilicate glass, and fused silica; or a combination of at least two thereof. For the use in this document, an aluminosilicate glass is a glass which has a content of $Al_2O_3$ of more than 8 wt.-%, such as more than 9 wt.-% or in a range from 9 to 20 wt.-%, in each case based on the total weight of the glass. An exemplary aluminosilicate glass has a content of $B_2O_3$ of less than 8 wt.-%, such as at maximum 7 wt.-% or in a range from 0 to 7 wt.-%, in each case based on the total weight of the glass. For the use in this document, a borosilicate glass is a glass which has a content of $B_2O_3$ of at least 1 wt.-%, such as at least 2 wt.-%, at least 3 wt.-%, at least 4 wt.-%, at least 5 wt.-%, or in a range from 5 to 15 wt.-%, in each case based on the total weight of the glass. An exemplary borosilicate glass has a content of $Al_2O_3$ of less than 7.5 wt.-%, such as less than 6.5 wt.-% or in a range from 0 to 5.5 wt.-%, in each case based on the total weight of the glass. In some embodiments, the borosilicate glass has a content of $Al_2O_3$ in a range from 3 to 7.5 wt.-%, such as in a range from 4 to 6 wt.-%, in each case based on the total weight of the glass.

A glass which may be provided according to the invention is essentially free from B. Therein, the wording "essentially free from B" refers to glasses which are free from B which has been added to the glass composition by purpose. This means that B may still be present as an impurity, but, for example, at a proportion of not more than 0.1 wt.-%, such as not more than 0.05 wt.-%, in each case based on the weight of the glass.

Medical, Pharmaceutical and Cosmetical Compositions

In the context of the invention, every medical composition, every pharmaceutical composition and every cosmetical composition which the skilled person deems suitable comes into consideration. A medical composition is a composition for the use in a medical treatment. A medical composition does not necessarily include an active ingredient. A pharmaceutical composition is a composition comprising at least one pharmaceutically active ingredient. An exemplary pharmaceutically active ingredient is a vaccine. A cosmetical composition is a composition comprising at least one cosmetically active ingredient. An exemplary cosmetically active ingredient is hyaluronic acid or botulinum toxin. The medical, pharmaceutical or cosmetical composition may be fluid or solid or both. An exemplary solid composition is granular such as a powder, a multitude of tablets or a multitude of capsules. A further exemplary medical, pharmaceutical or cosmetical composition is a parenterialium, i.e. a composition which is intended to be administered via the parenteral route, which may be any route which is not enteral. Parenteral administration can be performed by injection, e.g. using a needle (usually a hypodermic needle) and a syringe, or by the insertion of an indwelling catheter.

Secondary Packaging Container

The secondary packaging container may, generally, be any container which, for the skilled person, comes into consideration for accommodating the components of the holding device. An exemplary secondary packaging container is a tub. In some embodiments, the secondary packaging container is a tub of a so-called nested solution as they are generally known in the technical field of transport packaging for medical, pharmaceutical and cosmetical primary packaging containers. An example of a known nested solution is commercially available from Schott AG under the tradename SCHOTT iQ® platform. An exemplary secondary packaging container has been prepared by deep drawing or injection molding. Additionally or alternatively, the secondary packaging container may be made from one or more plastics. In this context, an exemplary plastic is one, selected from the group, consisting of a polycondensation polymer, for example polyethylene terephthalate; a polyacrylate, for example polymethylmethacrylate; and a polyolefin, for example polypropylene or polyethylene; or a combination of at least two thereof.

Test Methods

The following test methods are to be used in the context of the invention. Unless otherwise specified, the measurements have to be carried out at an ambient temperature of 23° C., an ambient air pressure of 100 kPa (0.986 atm) and a relative atmospheric humidity of 50%.

Wall Thickness and Tolerance of Wall Thickness

The wall thickness and deviations from the mean value of the wall thickness (tolerance) are determined in accordance with the following standards for the respective type of container:

DIN ISO 8362-1 for vials,

DIN ISO 9187-1 for ampoules,

DIN ISO 110 4 0-4 for syringes,

DIN ISO 13926-1 for cylindrical cartridges, and

DIN ISO 11040-1 for dental cartridges.

Exemplary embodiments provided according to the invention are set out in more detail below by use of examples and figures, with the examples and figures not denoting any restriction on the invention. Furthermore, unless otherwise indicated, the figures are not to scale.

FIG. 1 shows a scheme of a holding device 100 provided according to the invention for holding a plurality of at maximum 40 primary packaging containers 101. The holding device 100 consists of a first component 102 and a second component 104. Each of the first 102 and second components 104 is itself of a one-piece design, where the first component 102 has not been produced in one piece with the second component 104. Instead, the first 102 and second components 104 have been obtained in separate injection molding processes. The first component includes 40 first receptacles 103 which are through-holes of essentially hexagonal shape. The 40 first receptacles 103 are framed by a flat outer rim 108 of the first component 102. When the holding device 100 is stored in a tub, the flat outer rim 108 is supported by a step 605 (see FIG. 6) of the sidewalls of the tub. The second component 104 includes 40 cup-like second receptacles 105. The first component 102 and the second component 104 have been attached to one another by a combination of form-fit and adhesive bond, where the latter has been established by staking 4 spacer elements 404 (see FIG. 4) of the second component 104 to the underside of the first component 102. Accordingly, the holding device 100 is of a two-piece design. Details of the connection between the first 102 and second components 104 can be seen in FIGS. 3 to 5.

A length 106 and a width 107 of the first component 102 span a first component plane. A length 401 and a width 402 of the second component 104 (see FIG. 4) span a second component plane. Those first and second component planes are parallel to one another. The 40 first receptacles 103 form a first regular pattern in the first component plane. The 40 second receptacles 105 form a second regular pattern in the second component plane. Here, the first regular pattern is congruent with the second regular pattern. Further, in a direction which is perpendicular to the first and second component planes, each of the 40 first receptacles 103 is aligned with one of the 40 second receptacles 105.

FIG. 1 shows a single one of at maximum 40 cartridges as primary packaging containers 101 which can be non-destructively detachably accommodated in one of the 40 first receptacles 103 and, at the same time, in the one of the 40 second receptacles 105 which is aligned with the respective first receptacle 103 such that the first component 102 and the second component 104 together restrict movement of the respective primary packaging container 101 in the first and second component planes, and in the direction which is perpendicular to the first and second component planes. More specifically, the first component 102 restricts movement of the primary packaging container 101 in the first component plane, where the second component 104 restricts movement of the primary packaging container 101 in the second component plane and in the direction which is perpendicular to the first and second component planes. For each of the 40 first receptacles 103, the one of the 40 second receptacles 105 which is aligned with the respective first receptacle 103 has a minimum distance from the respective first receptacle 103. Here, the minimum distance is essentially the same for each of the 40 first receptacles 103. Each of the minimum distances is predetermined by the height of the 4 spacer elements 403 (see FIG. 4) of the second component 104.

The design of the above holding device 100 can easily be adapted to primary packaging containers 101 of different lengths by changing the height of the 4 spacer elements 403. This means that adapting the design of the holding device 100 requires merely a minor change in one of the 2 components of the holding device 100. This change can easily be implemented on the design side as well as on the side of the injection molding tools. This is different for nest designs of the prior art which include a holding structure that is made from only a single component. In these prior art cases, a completely new nest has to be designed and new injection molding tools have to be manufactured.

Further, the design of the holding device 100 of FIG. 1 can also easily be adapted to a set of primary packaging containers 101 of different diameter. Such an adaption requires exchanging inserts in the injection molding tools. In the case of prior art holding device designs, exchanging these inserts can be very cumbersome. This is particularly true for holding device designs for rather long primary packaging containers 101. In order to hold these rather long primary packaging containers 101, a 1-component holding device of the prior art needs to have a certain height. The greater the height of the holding device design, the more difficult it is to exchange the inserts of the injection molding tools. In some cases, it may even be impossible to exchange the inserts. This is different for the above design of the holding device 100 provided according to the invention. Due to the holding device 100 consisting of first 102 and second components 104, each single component may be rather thin, even for longer primary packaging containers 101. In result, the inserts of the injection molding tools used to prepare the components of the holding device 100 can easily be exchanged.

It is a further advantage of the holding device 100 of FIG. 1 that each of the 40 primary packaging containers 101 can be held in the same safe and secure manner during transport, handling and storage. This means that damages and abrasion to each of these 40 primary packaging containers 101 due to glass-to-glass or glass-to-plastic contact can be prevented or minimized. This is particularly important because damage or abrasion to only a single of the primary packaging containers 101 can produce particles which, during transport and handling, may spread across all of the primary packaging containers 101 held by the holding device. Needless to say, that particles on a primary packaging container 101 for medical, pharmaceutical or cosmetical compositions which may be administered by injection represent a severe health hazard and must be avoided.

Figure 3:
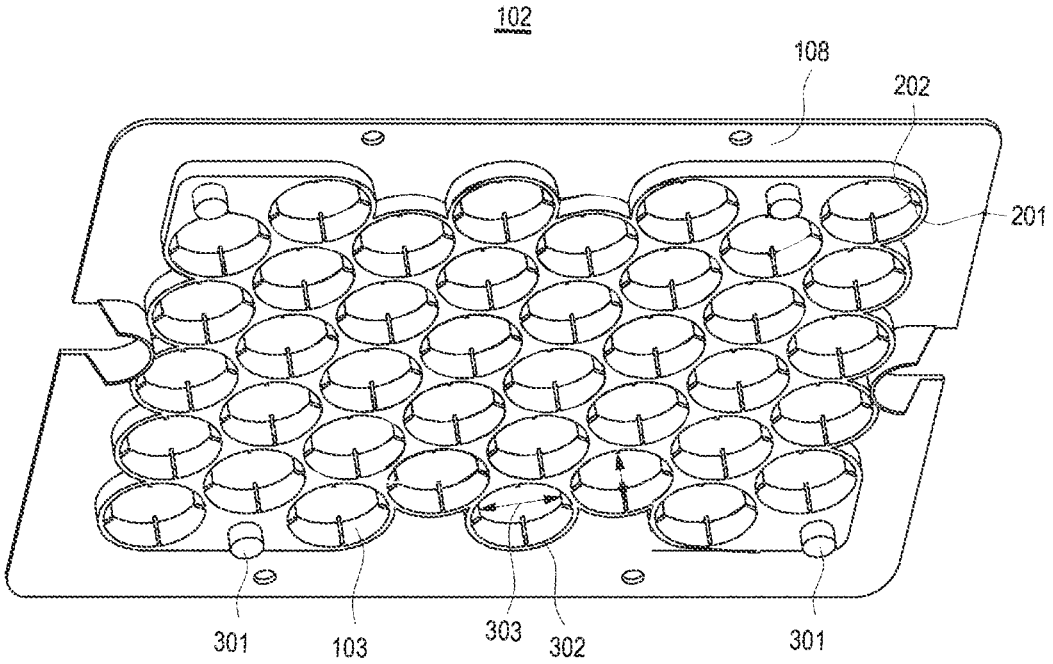
FIG. 3 illustrates a scheme of the first component of the holding device of FIG. 1 from below.
Figure 4:
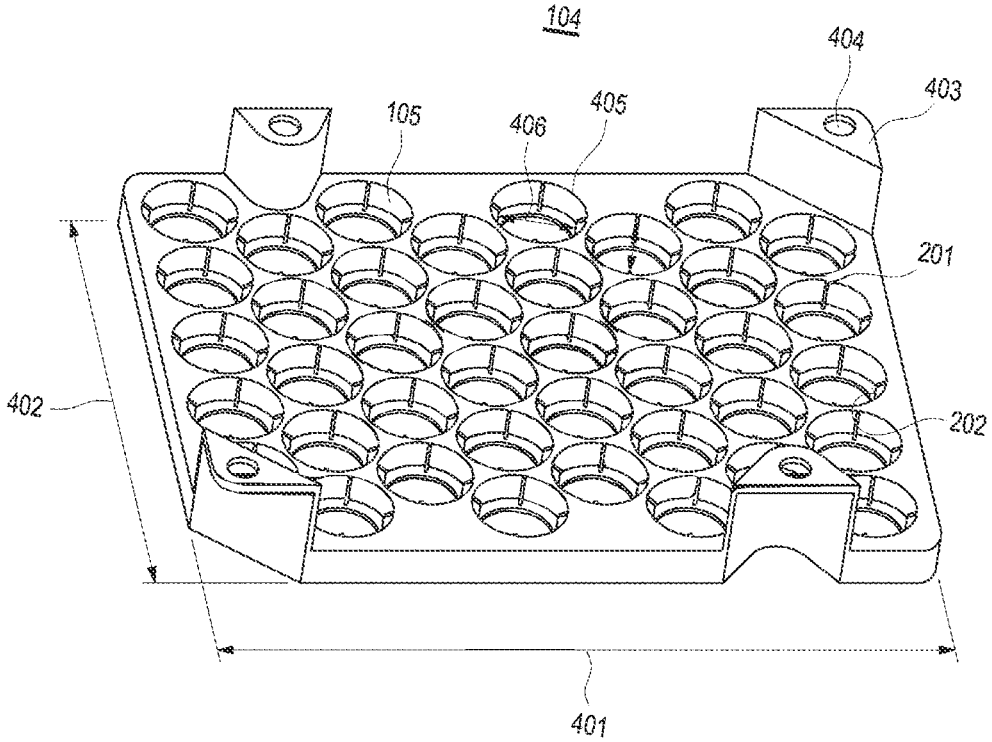
FIG. 4 illustrates a scheme of an exemplary embodiment of a second component of the holding device of FIG. 1 from above.

Further, each of the 40 first receptacles 103 has a first opening 302 which faces the second component 104 (see FIG. 3) and each of the 40 second receptacles 105 has a second opening 405 which faces the first component 102 (see FIG. 4). The first openings 302 of the 40 first receptacles 103 each have a first holding diameter 303 and the second openings 405 of the 40 second receptacles 105 each have a second holding diameter 406. For each of the first receptacles 103, a modulus of a difference between its first holding diameter 303 and the second holding diameter 406 of the one of the 40 second receptacles 103 which has the minimum distance from this first receptacle 103 is 0.4 mm. Surprisingly, this difference turned out to be particularly advantageous in terms of safe and secure holding of primary packaging containers 101, demolding of the holding device 100, and, at the same time, automatic processability of primary packaging containers 101 held by the holding device 100. A greater difference of the first 303 and second holding diameters 406 allows for easier demolding, but also leads to the primary packaging containers 101 being held less securely by the holding device 100 as the primary packaging containers 101 may be tilted in the first 103 and second receptacles 105. For prior art holding devices, demoldability defines a minimum difference of the first 303 and second holding diameters 406. Due to its 2-component design, the holding device 100 provided according to the invention can be demolded much easier. Accordingly, there is no minimum difference of the first 303 and second holding diameters 406. This is a huge advantage of the holding device 100 of FIG. 1 over prior art holding structures. In order to make the most of this advantage, one would design the holding device 100 such that the first 303 and second holding diameters 406 of corresponding first 103 and second receptacles 105 to be the same. A difference between first 303 and second holding diameters 406 of 0, however, surprisingly turned out to lead to failures in the automatic processing of the primary packaging containers 101. This processing includes gripping of the primary packaging containers 101, held by the holding device 100, by a robotic arm. The robotic arm is set to grip precisely to where the primary packaging container 101 should be if the holding device 100 was positioned perfectly. There is, however, a tolerance of the position of the holding device 100. In order to balance this tolerance, the positions of the primary packaging containers 101 need to have a certain tolerance as well. This is why a difference between the first 303 and second holding diameters 406 of slightly more than 0 is even more advantageous than a difference of 0. Further, it turned out that the difference range from 0.3 to 0.5 mm is most advantageous in terms of safe and secure holding of primary packaging containers 101, demolding of the holding device 100, and automatic processability of primary packaging containers 101 by the robotic arm.

Figure 2:
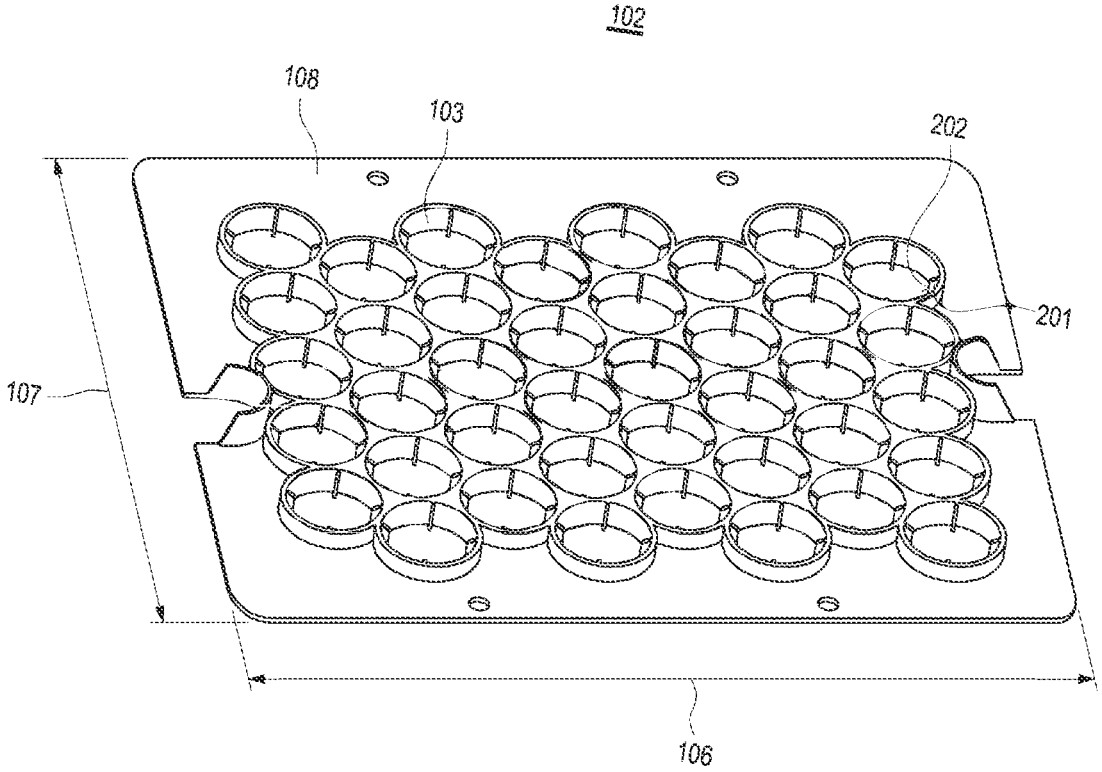
FIG. 2 illustrates a scheme of an exemplary embodiment of a first component of the holding device of FIG. 1 from above.

FIG. 2 shows a scheme of the first component 102 of the holding device 100 of FIG. 1. As can be seen, the first component 102 is plate-like and has an essentially rectangular shape in a top view. Further, each of the first receptacles 103 has 6 protrusion 201 at its sidewalls. The protrusions 201 protrude radially inwards towards a lateral center of the respective first receptacle 103. The protrusions 201 of the first receptacles 103 are designed to restrict movement of a primary packaging container 101 in the first component plane by radially inwards facing contact surfaces 202. At least part of each of the contact surfaces 202 of the 6 protrusions 201 of each of the first receptacles 103 lie on a cylinder shell surface. This cylinder shell surface has the first holding diameter.

FIG. 3 shows a scheme of the first component 102 of the holding device 100 of FIG. 1 from below. It can be seen that there are 4 round protrusions on the underside of the first component 102. These protrusions are male elements 301 of the form-fit between the first 102 and second components 104.

FIG. 4 shows a scheme of the second component 104 of the holding device 100 of FIG. 1. Here, the 4 spacer elements 403 can be seen which are in the form of pillars. A flat upper end of each of the spacer elements 403 has a through-hole which is a female element 404 of the form-fit between the first 102 and second components 104. Further, each of the second receptacles 105 has 6 protrusion 201 at its sidewalls. The protrusions 201 protrude radially inwards towards a lateral center of the respective second receptacle 105. The protrusions 201 of the second receptacles 105 are designed to restrict movement of a primary packaging container 101 in the second component plane by radially inwards facing contact surfaces 202. At least part of each of the contact surfaces 202 of the 6 protrusions 201 of each of the second receptacles 105 lie on a cylinder shell surface. This cylinder shell surface has the second holding diameter.

Figure 5:
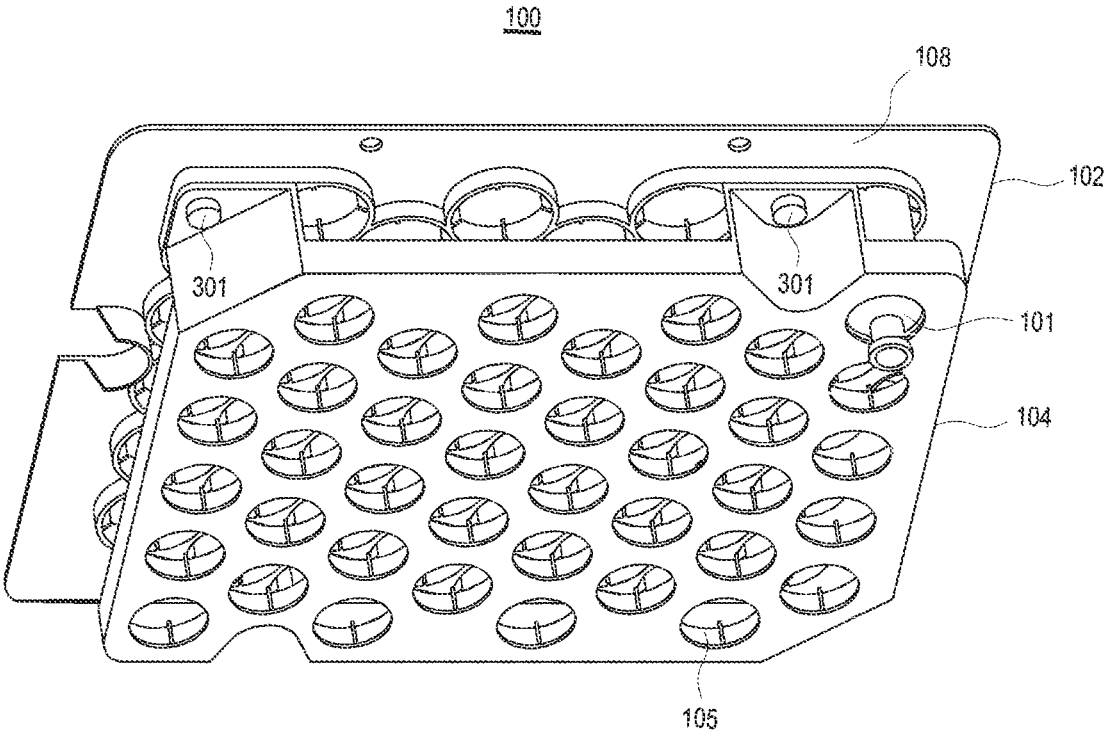
FIG. 5 illustrates a scheme of an exemplary embodiment of a holding device provided according to the invention from below.

FIG. 5 shows a scheme of a holding device 100 provided according to the invention from below. It can be seen how the male elements 301 engage with the female elements 404 (see FIG. 4) to establish the form-fit between the first 102 and second components 104.

Figure 6:
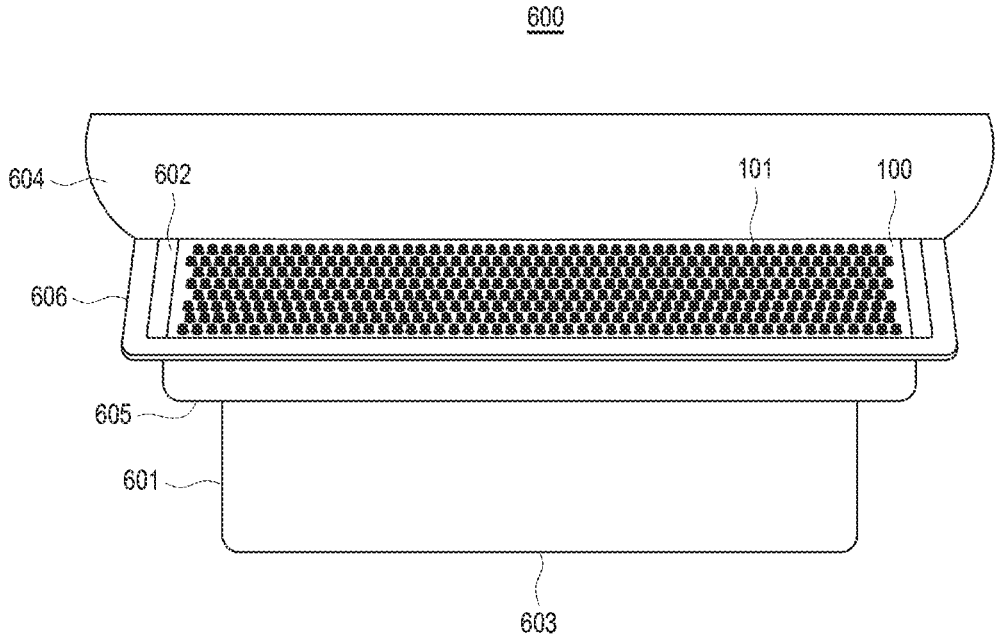
FIG. 6 illustrates a scheme of an exemplary embodiment of an arrangement provided according to the invention.

FIG. 6 shows a scheme of an arrangement 600 provided according to the invention. This arrangement 600 includes the holding device 100 of FIG. 1 and 40 primary packaging containers 101 which are cartridges of the type shown in FIG. 1. Each of the cartridges is non-destructively detachably accommodated in one of the 40 first receptacles 103 and one of the 40 second receptacles 105 such that the first component 102 restricts movement of each cartridge in the first component plane and the second component 104 restricts movement of the respective cartridge in the second component plane and perpendicular thereto. The arrangement 600 further includes a secondary packaging container 601 which is a tub. A container body of the secondary packaging container 601 includes a container opening 602 and a container base 603 which is opposite to the container opening 602. The first component 102, the second component 104 and the 40 cartridges are arranged completely in the secondary packaging container 601. Further end parts 703 of the cartridges (see FIG. 7) face the container base 603. In other words: the cartridges are held upside down in by the holding device 100. The sidewalls of the tub have a step 605 which supports the flat outer rim 108 of the first component 102. A gas-permeable lid 604 has been adhesively sealed to an upper rim 606 of the tub. Between the lid 604 and the cartridges, there is disposed a multi-layer sheet which is available under the tradename Tyvek® from DuPont de Nemours (Deutschland) GmbH (not shown). The height difference between the upper rim and the further end parts 703 of the cartridges is exactly at 3.5 mm. It is important that this height difference is met precisely to allow for automatic processing of the cartridges. In FIG. 6, the gas-permeable lid 604 has been peeled off partially to reveal the inside of the tub.

Figure 7:
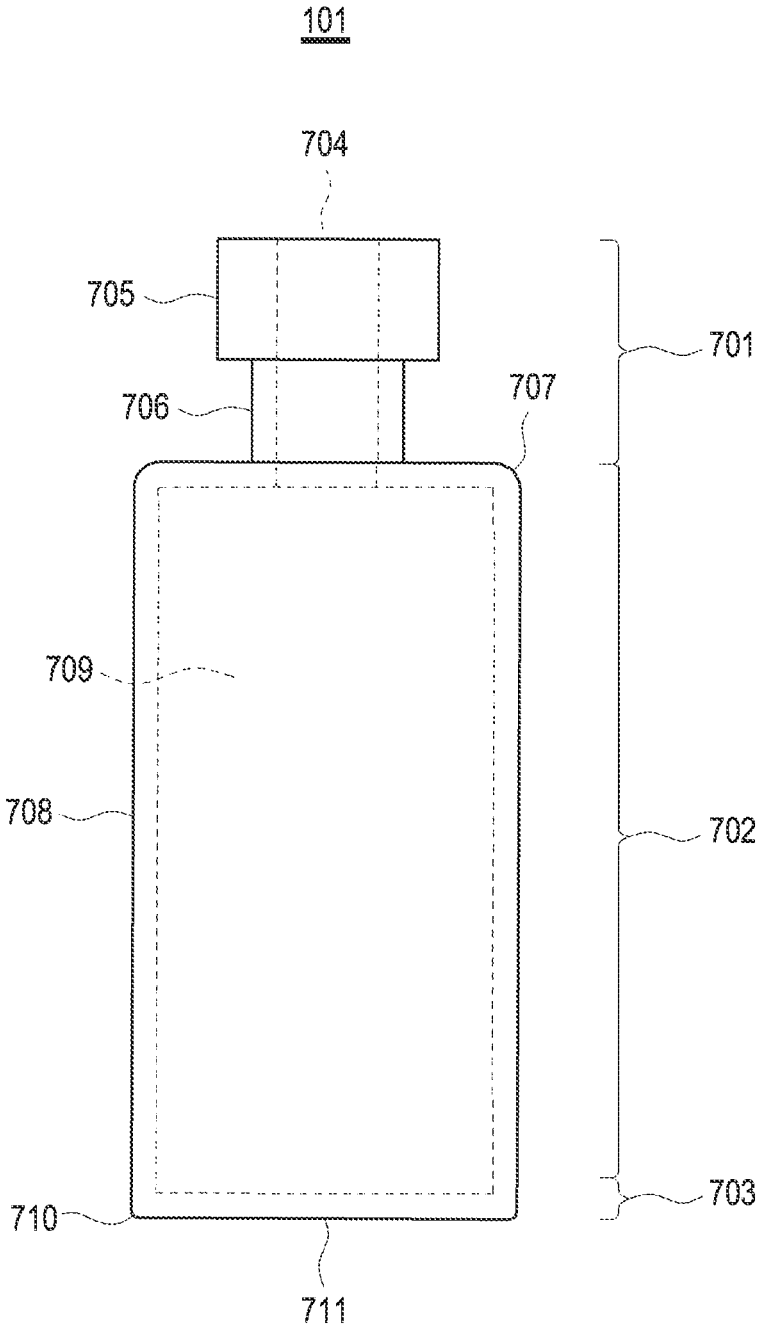
FIG. 7 illustrates a scheme of a primary packaging container.

FIG. 7 shows a side-view scheme of the primary packaging container 101 of FIG. 1. This cartridge includes a container wall 708 which partially surrounds a container interior 709. The container wall 708 forms, in the following sequence from top to bottom, a first end part 701, including a discharge orifice 704; a body part 702; and a further end part 703. The body part 702 is a hollow cylinder. The further end part 703 includes a standing base 711. Besides the discharge orifice 704, the first end part 701 consists of a flange 705 and a neck 706. The body part 702 follows the first end part 701 via a shoulder 707. The further end part 703 follows the body part 702 via a heel 710. The container wall 708 is made from type I borosilicate glass.

Figure 8:
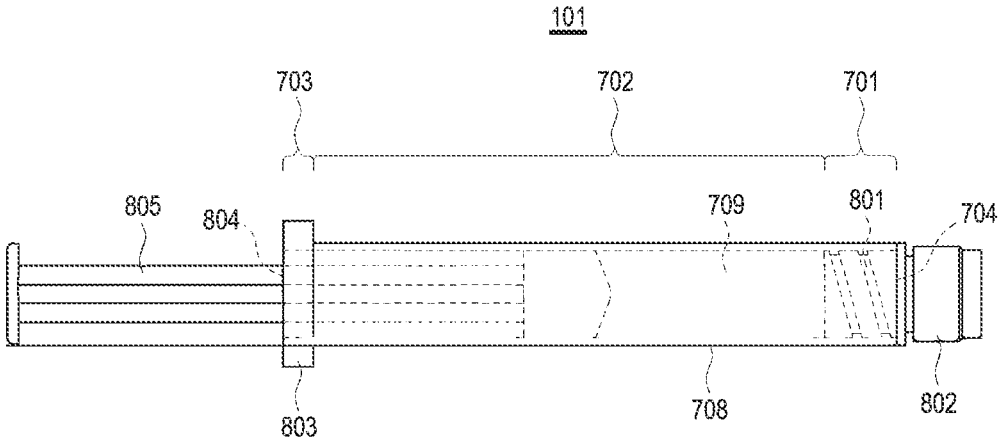
FIG. 8 illustrates a scheme of a further primary packaging container.

FIG. 8 shows a scheme of a further type of primary packaging container 101 which comes into consideration for being held by a holding device 100 provided according to the invention. This primary packaging container 101 is a syringe. Just as the cartridge of FIG. 7, the syringe includes a container wall 708 which partially surrounds a container interior 709. The container wall 708 forms, in the following sequence from top to bottom, a first end part 701, including a discharge orifice 704; a body part 702; and a further end part 703, including a further orifice 804. The body part 702 is a hollow cylinder which, in the art, is also referred to as barrel. The discharge orifice 704 has an orifice area which is less than an orifice area of the further orifice 804. The further orifice 804 accommodates a plunger 805. The further end part 703 further includes a rim 803, in the art also referred to as flange, which projects laterally from the body part 702 and hems the further orifice 804. The container wall 708 is made from a cyclic olefin copolymer. The first end part 701 includes a connecting element which is a male part 801 of a Luer taper. The connecting element includes a thread for connecting a hypodermic needle to the syringe. The thread is arranged in a sleeve. The discharge orifice 704 is closed by a rubber stopper 802. Typically, syringes of the type shown in FIG. 8 are stored and transported in nested solutions with such a stopper 802, but without plunger 805.

Figure 9:
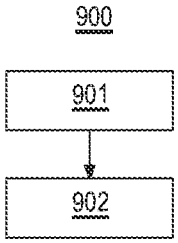
FIG. 9 illustrates a flow chart of an exemplary embodiment of a process provided according to the invention.

FIG. 9 shows a flow chart of a process 900 provided according to the invention for preparing the holding device 100 of FIG. 1. The process 900 includes a process step a. 901 of forming the first component 102 and the second component 104 by separate injection molding methods. In a subsequent process step b. 902, the first component 102 and the second component 104 are superimposed and staked to one another, thereby establishing the form-fit and attaching the first component 102 to the spacer elements 404 of the second component 104.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE NUMERALS

100 holding device provided according to the invention/first holding device
101 primary packaging container/primary packaging container of the first kind
102 first component
103 first receptacle
104 second component
105 second receptacle
106 length of the first component
107 width of the first component
108 flat outer rim
301 male element of form fit
302 first opening
303 first holding diameter
201 protrusion
202 contact surface
401 length of the second component
402 width of the second component
403 spacer element
404 female element of form fit
405 second opening
406 second holding diameter
600 arrangement provided according to the invention
601 secondary packaging container
602 container opening
603 container base
604 lid
605 step of sidewall
606 upper rim
701 first end part
702 body part
503 further end part
704 discharge orifice
705 flange
706 neck
707 shoulder
708 container wall
709 container interior
710 heel
711 standing base
801 male part of Luer taper
802 stopper
803 rim
804 further orifice
805 plunger
900 process provided according to the invention
901 process step a.
902 process step b.

What is claimed is:

1. An arrangement, comprising:

a holding device for holding a plurality of at maximum n primary packaging containers, wherein n is a positive integer, the holding device comprising:

a first component comprising a plurality of n first receptacles, wherein a length and a width of the first component span a first component plane; and a second component comprising a plurality of n second receptacles, wherein a length and a width of the second component span a second component plane; wherein the first component and the second component superimpose one another such that each of the n primary packaging containers can be detachably accommodated in one of the n first receptacles and, at the same time, one of the n second receptacles such that the first component and the second component together restrict movement of the respective primary packaging container in the first component plane or the second component plane and in a direction which is perpendicular to the first component plane or the second component plane; wherein, for each of the n first receptacles, there is one of the n second receptacles which has a minimum distance from the respective first receptacle and, for each of the n first receptacles, the minimum distance is predetermined by the second component, at least one third component of the holding device, or both, wherein the first component comprises a first surface that faces the second component and a second surface opposite the first surface, the n first receptacles extending past both the first surface and the second surface.

2. The arrangement of claim 1, wherein for each of then first receptacles the minimum distance is essentially the same.

3. The arrangement of claim 1, wherein the first component and the second component superimpose one another such that each of the n primary packaging containers can be accommodated in one of the n first receptacles and, at the same time, one of the n second receptacles such that:

the first component restricts movement of the respective primary packaging container at least in the first component plane and the second component restricts movement of this primary packaging container in the direction which is perpendicular to the first component plane; or the second component restricts movement of the respective primary packaging container at least in the second component plane and the first component restricts movement of this primary packaging container in the direction which is perpendicular to second component plane.

4. The arrangement of claim 1, wherein the first component and the second component are non-destructively detachably or not non-destructively detachably attached to one another, to at least one third component of the holding device, or both.

5. The arrangement of claim 1, wherein, in the direction which is perpendicular to the first component plane or the second component plane, each of the n first receptacles is aligned with one of the n second receptacles.

6. The arrangement of claim 1, wherein the n first receptacles form a first regular pattern in the first component plane, the n second receptacles form a second regular pattern in the second component plane, and the first regular pattern is congruent with the second regular pattern.

7. The arrangement of claim 1, wherein the holding device further comprises a secondary packaging container comprising a container body, the container body of the secondary packaging container comprising:

a container opening; and a container base which is opposite to the container opening, wherein at least the first component and the second component are arranged completely in the secondary packaging container.

8. The arrangement of claim 7, wherein the holding device comprises the at least one third component arranged completely in the secondary packaging container.

9. The arrangement of claim 1, wherein n is in a range from 4 to 500.

10. The arrangement of claim 1, wherein each of the n first receptacles has a first opening which faces the second component, each of the n second receptacles has a second opening which faces the first component, the first openings of the n first receptacles each have a first holding diameter, the second openings of the n second receptacles each have a second holding diameter, and, for each of the first receptacles of the plurality of n first receptacles, a modulus of a difference between its first holding diameter and the second holding diameter of the one of the n second receptacles which has the minimum distance from this first receptacle is not more than 0.5 mm.

11. The arrangement of claim 1, further comprising at least part of the n primary packaging containers, wherein each of the at least part of the n primary packaging containers is detachably accommodated in one of the n first receptacles and one of the n second receptacles such that the first component and the second component together restrict movement of the respective primary packaging container in the first component plane or the second component plane and in a direction which is perpendicular to the first component plane or the second component plane.

12. The arrangement of claim 11, wherein each of the at least part of the n primary packaging containers is detachably accommodated in one of the n first receptacles and one of the n second receptacles such that:

the first component restricts movement of the respective primary packaging container at least in the first component plane and the second component restricts movement of this primary packaging container in the direction which is perpendicular to the first component plane; or the second component restricts movement of the respective primary packaging container at least in the second component plane and the first component restricts movement of this primary packaging container in the direction which is perpendicular to second component plane.

13. The arrangement of claim 11, further comprising an outer packaging, wherein the secondary packaging container is arranged in the outer packaging.

14. The arrangement of claim 1, further comprising a fourth component comprising a plurality of m third receptacles, a length and a width of the fourth component spanning a fourth component plane; wherein, when the first component and the fourth component are superimposed with one another, a further holding device is formed for holding a plurality of at maximum m primary packaging containers of a further kind, wherein m is a positive integer which is equal to or less than n; wherein, in the further holding device, each of the m primary packaging containers of the further kind can be detachably accommodated in one of the n first receptacles and, at the same time, one of the m third receptacles such that the first component of the further holding device and the fourth component together restrict movement of the respective primary packaging container of the further kind in the first component plane of the first component of the further holding device or the fourth component plane and in a direction which is perpendicular to the first component plane of the first component of the further holding device or to the fourth component plane; wherein, for each of the m third receptacles, there is one of the n first receptacles of the first component of the further holding device which has a minimum distance from the respective third receptacle; wherein, for each of the m third receptacles, the minimum distance is predetermined by the fourth component, at least one fifth component of the further holding device, or both.

15. The arrangement of claim 14, wherein the fourth component is identical to the second component.

16. The arrangement of claim 15, wherein at least one of the following is satisfied:

when the first component and the fourth component are superimposed with one another to form the further holding device, the formed further holding device comprises at least one fifth component and the minimum distance is predetermined by the at least one fifth component; or the holding device comprises the at least one third component and the minimum distance is predetermined by the at least one third component.

17. The arrangement of claim 15, wherein each of the m primary packaging containers of the further kind differ from each of the n primary packaging containers.

* * * * *